United States Patent [19]

Haskins

[11] Patent Number: 4,905,609

[45] Date of Patent: Mar. 6, 1990

[54] WORK STATION

[75] Inventor: Gordon Haskins, Battle Creek, Mich.

[73] Assignee: Style Line Products, Inc., Sturgis, Mich.

[21] Appl. No.: 312,905

[22] Filed: Feb. 21, 1989

[51] Int. Cl.[4] ..... A47B 3/06

[52] U.S. Cl. ..... 108/23; 312/196

[58] Field of Search ..... 312/195, 196, 209, 210, 312/190; 108/60, 153, 111, 23

[56] References Cited

U.S. PATENT DOCUMENTS

| | | | |
|---|---|---|---|
| 1,334,949 | 3/1920 | Falls | 312/196 |
| 2,696,415 | 12/1954 | Himelson . | |
| 2,944,861 | 7/1960 | Lessin | 312/196 |
| 3,027,214 | 3/1962 | Curatolo | 312/196 X |
| 3,156,510 | 11/1964 | Hinden et al. | 108/23 X |
| 3,316,041 | 4/1967 | Nelson | 312/140 |
| 3,325,233 | 6/1967 | Oppenhuizen et al. . | |
| 3,406,645 | 10/1968 | Monroe | 108/23 |
| 3,550,540 | 12/1970 | Albrecht et al. | 108/23 |
| 4,272,136 | 6/1981 | Senguna | 312/196 |
| 4,536,044 | 8/1985 | Ziegelheim et al. . | |
| 4,624,509 | 11/1986 | Ramsey . | |
| 4,691,644 | 9/1987 | Frydman . | |

*Primary Examiner*—Peter A. Aschenbrenner

*Attorney, Agent, or Firm*—Harness, Dickey & Pierce

[57] ABSTRACT

An improved work station is disclosed which is particularly well suited for activities associated with statistical process control in manufacturing operations as well as a wide variety of other applications. The work station provides a rugged frame assembly which supports a work surface having secured thereto in upstanding relationship a privacy panel assembly surrounding a portion of the work surface. The privacy panels comprise a slotted frame having individual panels removably inserted therein along with spacer means to avoid annoying rattle. A light and valance are also provided which are supported on the privacy panels and adjustable telescopic legs are incorporated to enable the work surface to be positioned at a comfortable working level.

16 Claims, 6 Drawing Sheets

FIG. 6.
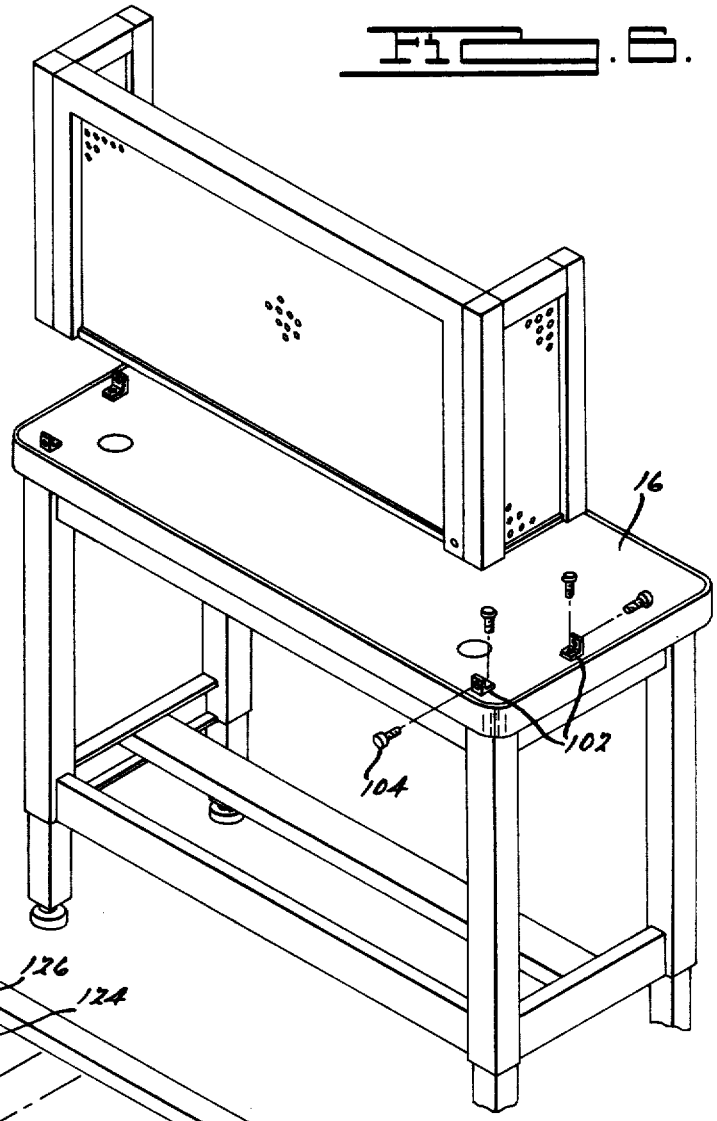
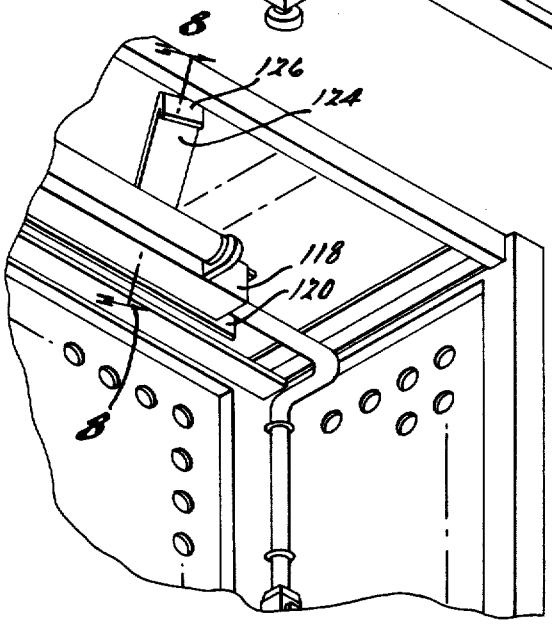
FIG. 7.

WORK STATION

BACKGROUND AND SUMMARY OF THE INVENTION

The present invention relates generally to work stations and more specifically to such work stations which are designed primarily for use in non-office type environments such as for example manufacturing statistical process control applications.

There exists a wide variety of applications wherein a work station is desirable so as to afford a convenient location for storage of instruments, charts, etc. as well as to provide a suitable work surface for recordal of information etc. An example of one such application is in connection with manufacturing or process operations employing a form of statistical process control. Typically, in such an operation, various charts, graphs and other record-keeping activities must be performed along with the gathering of information from the ongoing manufacturing or process operation. In addition to the storage of paperwork and records, various instruments and tools may be required for use in connection with the process monitoring and/or information gathering functions. These activities thus often require a work surface for writing or the like as well as means for organized storage of both records and instruments being utilized.

As these activities are typically carried out in the plant itself, conventional desks of the type used in a typical office are not well suited as they typically do not provide for adequate privacy, lighting nor sufficiently convenient and organized storage for tools and/or instruments being utilized.

The present invention, however, provides a work station which is exceedingly well suited for these as well as a wide variety of other applications. The work station of the present invention provides a work surface which is well suited for carrying out the various record-keeping activities and which incorporates a series of panels secured thereto which afford the desired degree of privacy to minimize the potential of error inducing distractions. Further, the panels may be of a variety of materials including such as pegboard to thereby provide convenient and easily accessible storage for tools and/or instruments as well as display of charts. Lighting means are also incorporated into the work station to assure a sufficient level of illumination for the tasks to be conducted. A valance is also provided to diffuse the light thereby avoiding undesirable glare as well as a means for displaying signage indicative of the activities being carried on or the presence of outside company personnel. Adjustable legs are incorporated into the work station as well so as to assure the working surface may be positioned at a comfortable height for the given type of activities. The work station is designed to be fabricated primarily from steel box channel so as to afford a durable, rugged, long lasting assembly well able to withstand the rigors of a shop environment.

Additional advantages and features of the present invention will become apparent from the subsequent description and the appended claims taken in conjunction with the accompanying drawings.

BRIEF DESCRIPTION OF THE DRAWINGS

FIG. 6 is a fragmentary perspective view of the work station of FIG. 1, showing the upper privacy panel assembly being secured to the lower desk portion;

FIG. 7 is a fragmentary perspective view of the work station of FIG. 1 illustrating installation of an auxiliary lighting unit;

DESCRIPTION OF THE PREFERRED EMBODIMENTS

Figure 1:
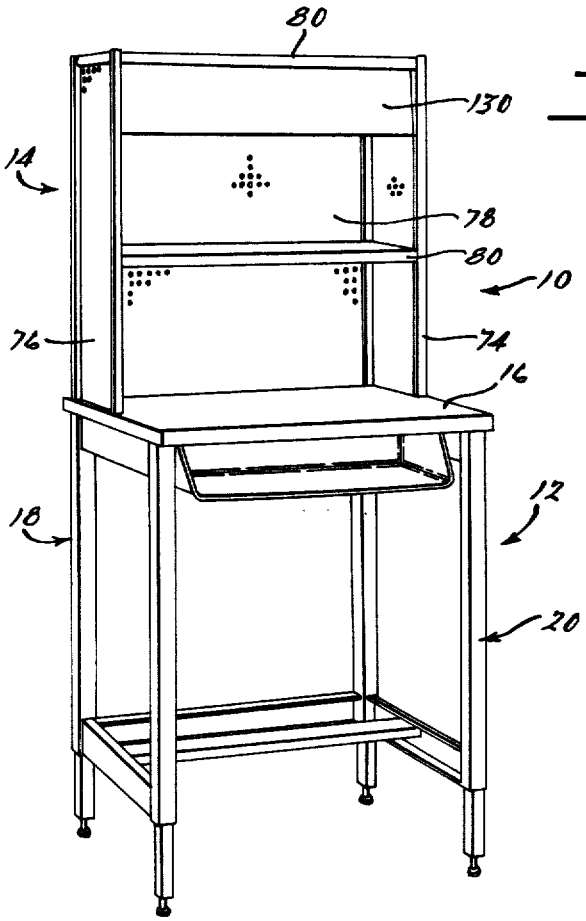
FIG. 1 is a perspective view of a work station in accordance with the present invention.

Referring now to the drawings and in particular to FIGS. 1 through 5, there is shown a work station in accordance with the present invention illustrated generally at 10. Work station 10 comprises a lower supporting table assembly 12 having a privacy panel assembly 14 supportingly secured thereto and enclosing on three sides a space above the upper work surface 16 of table assembly 12.

Figure 2:
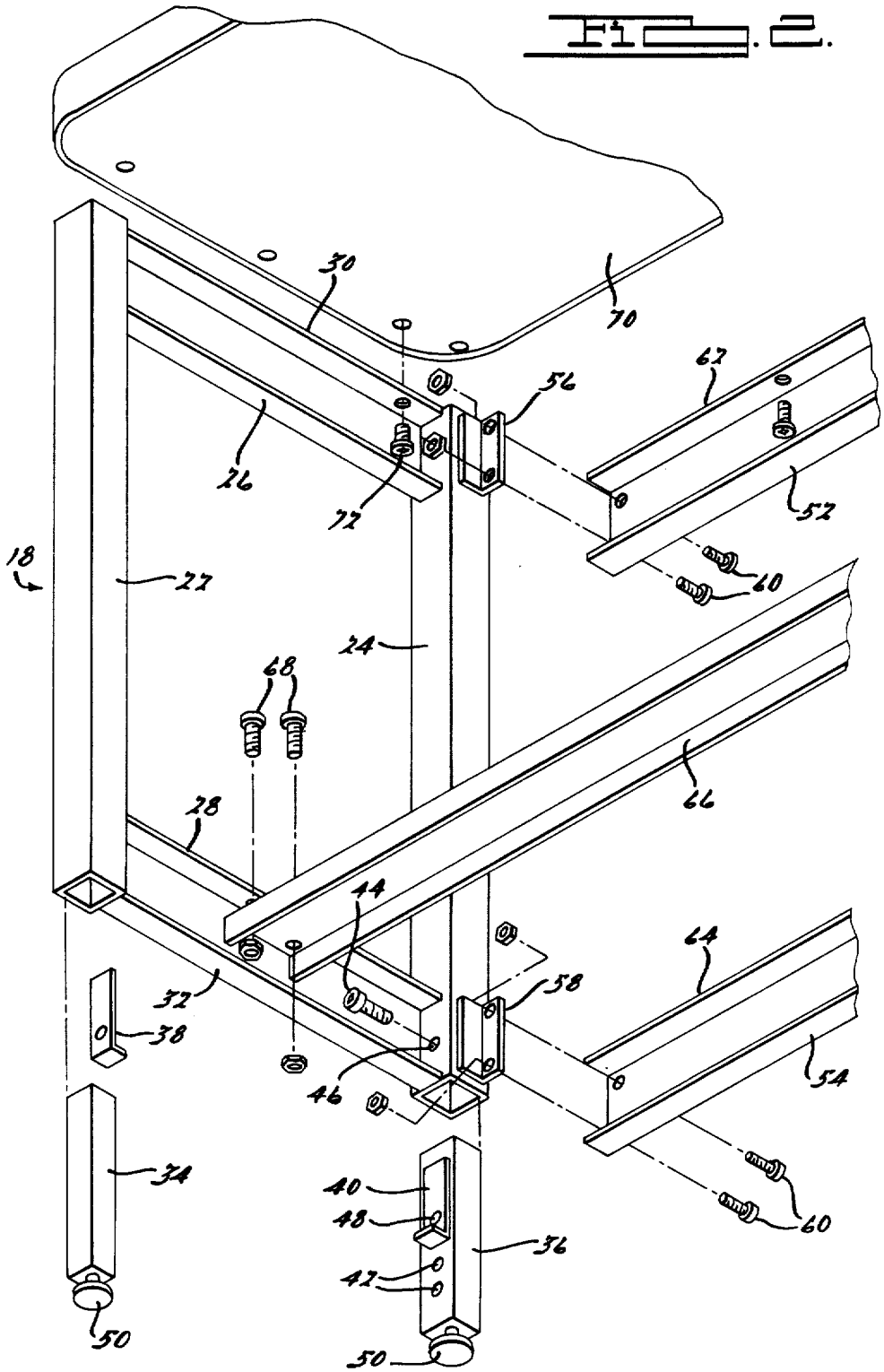
FIG. 2 is an exploded fragmentary perspective view of the lower portion of the work station of FIG. 1 illustrating the leg support assembly.

As best seen with reference to FIGS. 1 and 2, table assembly 12 includes two substantially identical leg assemblies 18 and 20. As leg assemblies 18 and 20 are identical, only leg assembly 18 will be described in detail. Leg assembly 18 comprises a pair of elongated hollow members 22, 24 of generally rectangular cross section interconnected at opposite ends thereof by generally U-shaped elongated channel members 26, 28. Preferably, U-shaped channel members 26 and 28 are secured to hollow members 22, 24 by welding and will be positioned with the outer surfaces of respective flange portions 30, 32 in substantially coplanar relationship with the respective end surfaces of hollow members 22, 24.

Each of the hollow members is designed to adjustably telescopically receive a hollow generally rectangular extension member 34, 36 and an L-shaped bracket member 38, 40. A plurality of spaced openings 42 are provided along one side of each of the extension members 34, 36 which are adapted to receive a fastener 44 extending through openings 46, 48 in respective hollow members 22, 24 and L-shaped brackets 38, 40 whereby the overall length (and hence height of work surface 16) may be easily and conveniently adjusted. Preferably extensions 34 and 36 will have suitable leveling support pads 50 provided on the lower ends thereof or alternatively, suitable casters preferably of the locking type may be provided.

In order to interconnect leg assemblies 18 and 20, a pair of elongated U-shaped channel members 52 and 54 are provided which are secured to L-shaped brackets 56, 58 welded adjacent opposite ends of hollow member 24 by means of a plurality of bolts 60. Preferably, respective flanges 62, 64 of channel members 52, 54 will be positioned in substantially coplanar relationship with the ends of hollow member 24. In order to further rigidify supporting table assembly 12 as well as to provide a foot rest, a third U-shaped channel member 66 is provided extending between and secured to respective interconnecting channel members 28 approximately midway along the length thereof by fasteners 68.

A top 70 defining work surface 16 is secured to the upper end of respective interconnected leg assemblies 18 and 20 by means of a plurality of fasteners 72 extending through suitable openings provided in flanges 30, 30' and 62. Preferably top 70 will be of substantial thickness and incorporate a suitable durable work surface 16 such as may be afforded by a high pressure plastic laminate and will be sized so as to fully overlie the interconnected leg assemblies 18, 20.

In order to afford a level of privacy for work station 10 as well as to provide storage means for tools, instruments, and papers or the like, privacy assembly 14 is provided which comprises three generally vertically extending side panel assemblies 74, 76 and 78 and a top/shelf member 80. Side panel assemblies 74, 76 and 78 are each substantially identical in construction with panel assemblies 74 and 76 being of substantially identical size and side panel assembly 78 being of the same vertical height but substantially longer so as to enable it to span the lateral width of work surface 16. Accordingly, only panel assembly 74 will be described in detail with corresponding portions of panel assemblies 76 and 78 being indicated by the same reference numbers primed and double primed as necessary.

Figure 4:
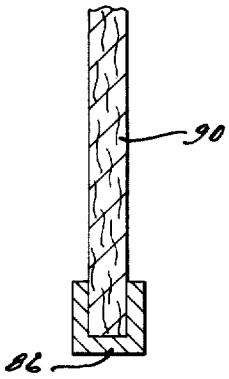
FIG. 4 is a fragmentary section view of one of the panel assemblies shown in FIG. 3, the section being taken along line 4—4 thereof.
Figure 5:
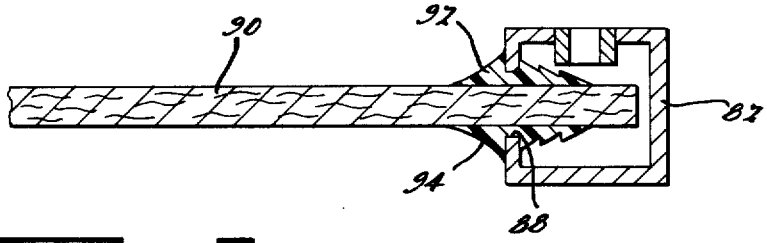
FIG. 5 is a fragmentary section view of one of the panel assemblies shown in FIG. 3, the section being taken along line 5—5 thereof.
Figure 3:
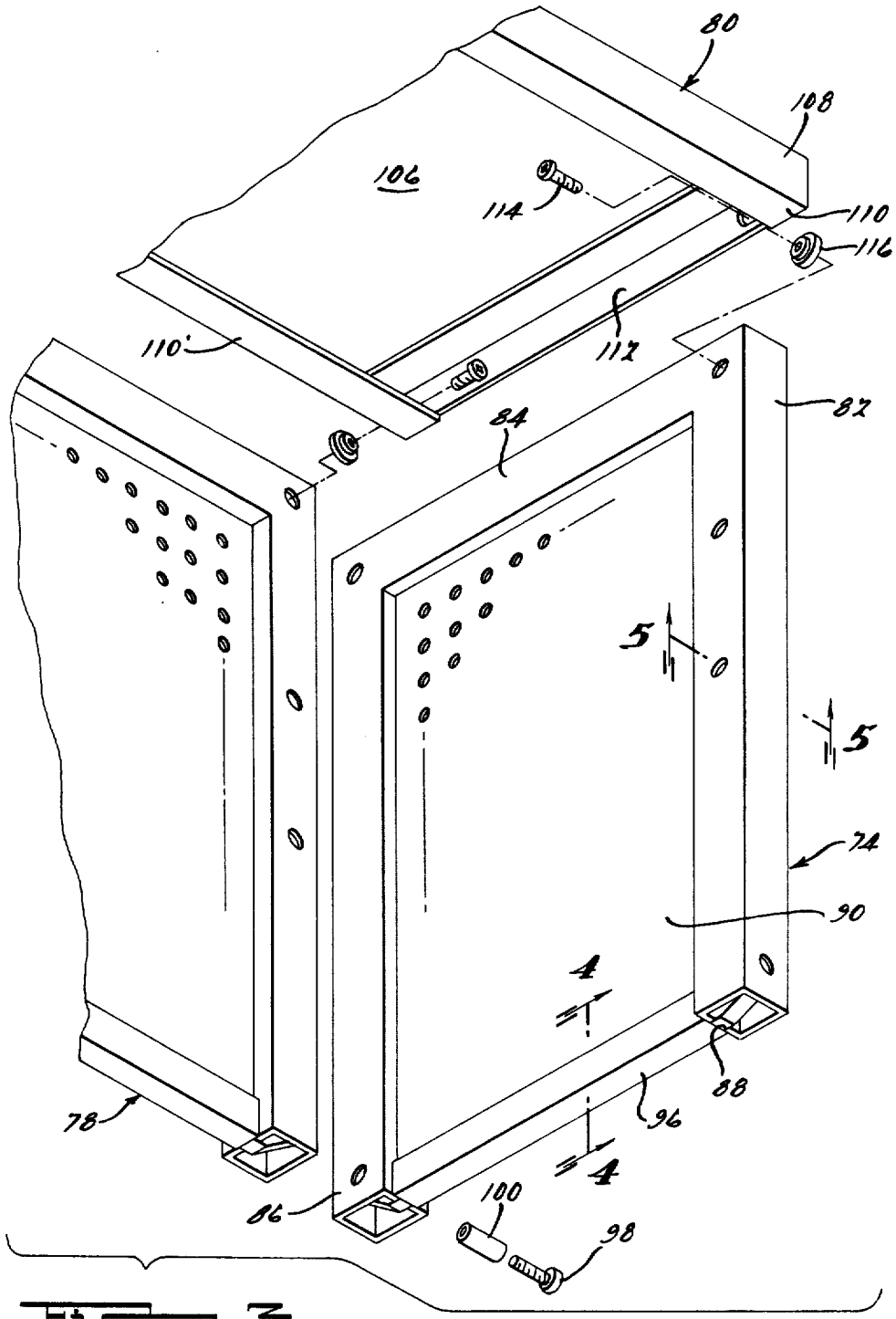
FIG. 3 is an exploded fragmentary perspective view of the upper portion of the work station of FIG. 1 illustrating the assembly of the privacy panels associated therewith.
Figure 8:
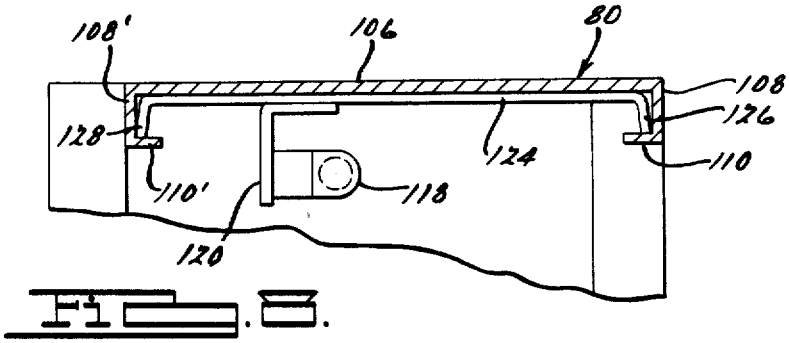
FIG. 8 is a fragmentary section view showing the auxiliary lighting unit fully installed, the section being taken along line 8—8 of FIG. 7.

As best seen with reference to FIGS. 3 through 5, panel assembly 74 comprises a three sided frame fabricated from three elongated hollow steel members 82, 84, 86 generally square in cross section and each of which has a slot extending longitudinally over the length thereof. Preferably, an end of each of hollow members 82 and 86 are welded or otherwise secured to opposite ends of hollow member 84 with the slots 88 provided thereon being aligned and facing inwardly so as to receive a suitably sized sheet panel 90 such as a pegboard panel as shown which may be slid in through the open end of the frame. Preferably slots 88 will be wider than the thickness of the sheet panel 90 being utilized and the panel 90 will be of a size so as to extend a distance into the interior of the hollow frame members. In order to prevent noise generating vibration of the panel 90 within the frame assembly, suitable resilient spacer strips 92, 94 are provided which may be inserted between the edges of slots 88 and panel member 90 on both sides thereof as shown in FIG. 5. In some cases, it may be desirable to employ panels 90 of greater thickness in which case only a single spacer strip 92 on one side of the panel may be utilized. In any event, the spacer strips 92, 94 provide both a finished appearance to the assembly as well as allowing the panel 90 to float within the frame assembly so as to thereby accommodate relative unequal expansion or contraction of the components. In order to finish the lower edge of the panel member 90 as well as to rigidify same, a relatively narrow U-shaped channel member 96 of a length sufficient to extend between and abut the sides of respective hollow members 82, 86 of the frame assembly is secured thereto by suitable fasteners such as pop rivets or even an appropriate adhesive. It should be noted that other types of panels 90 may be utilized such as for example sheet metal, wood or any other suitable material. Additionally, because panel member is not positively secured within the frame, it is possible to easily and conveniently replace the panel should it become damaged or replacement be otherwise desirable.

Side panel assemblies 74, 76, and 78 are secured together by means of suitable fasteners 98 extending through openings in the vertically extending upright frame members of panel assemblies 76 and 78 and threadedly engaging threaded inserts secured with suitably positioned openings provided in the vertical upright frame members 82", 86" of panel assembly 78. Suitable spacers 100 may be employed to prevent distortion of the frame during assembly.

The three panel members as thus secured in assembled relationship may then be secured to work surface 16 by means of a plurality of L-brackets 102 secured to surface 16 and extending into the lower ends of the respective hollow channels 82, 82', 82", 86" of frame members 74, 76, 78. Suitable fasteners 104 serve to secure the assembled panel members to these L-shaped brackets.

An optional top/shelf 80 is preferably fabricated from suitable sheet metal stock and sized to fit within the confines delineated by the assembled panel members. Top/shelf 80 includes an elongated generally planar upper flange portion 106 the opposite longitudinally extending edges of which have been folded so as to provide a finished depending edge flange portion 108, 108' and an inwardly extending relatively short flange portion 110, 110' positioned in generally spaced parallel relationship to flange portion 106. L-shaped angle members 112 are secured at opposite longitudinal ends of top/shelf 80 so as to provide an edge therealong for use in attaching same. Suitable threaded fasteners 114 and spacers 116 are provided which fasteners extend through openings in angle member 112 and edge flange 108' of shelf 80 into threaded engagements with threaded inserts provided in the respective panel members. Additional substantially identical top/shelf units 80 may be provided if desired being secured to the panel members in a similar manner at suitable heights therealong to provide additional storage.

Work station 10 is also designed to provide auxiliary lighting for the work surface as well as for informational signage if desired. With reference to FIGS. 7 through 10, a conventional light fixture 118 such as a single tube fluorescent fixture or the like is provided being supportingly secured to an elongated angle bracket 120. An elongated pair of arm members 122, 124 are pivotably secured to a flange portion of bracket 120 intermediate their ends. Each of the arms includes depending flange portions 126, 128 at opposite ends thereof which are adapted to engage and be supported upon flange portions 110, 110' of top/shelf 80. In order to assemble the light fixture to work station 10, the assembly is positioned against the lower surface of flange 106 and arms 124 are pivoted so as to engage respective flanges 110, 110'.

Figure 9:
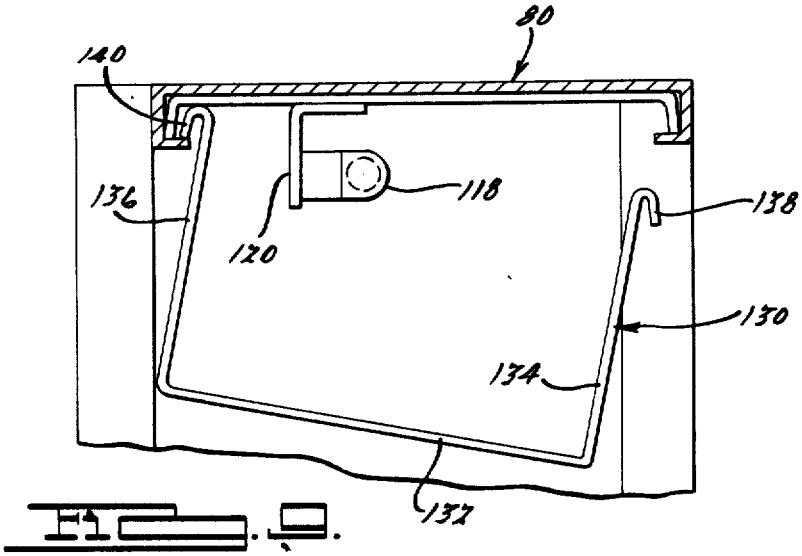
FIG. 9 is a view similar to that of FIG. 8 but showing a light diffusing valance being installed in surrounding relationship to the auxiliary lighting unit.
Figure 10:
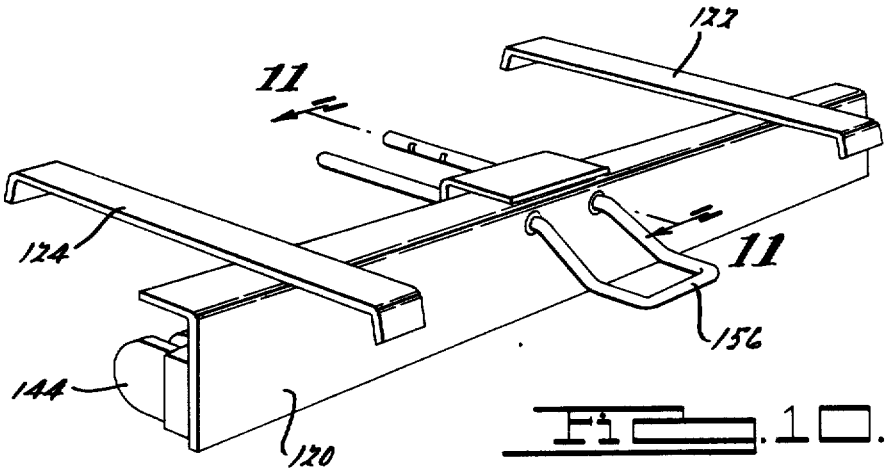
FIG. 10 is a perspective view of a modified auxiliary lighting unit for use in connection with the work station of FIG. 1, all in accordance with the present invention.

Work station 10 also provides an easily removable valance 130 adapted to be suspended from top/shelf 80. As shown in FIG. 9, valance 130 is preferably fabricated from a suitable light diffusing polymeric composition and is molded as a one piece structure including an elongated center portion 132 and spaced upwardly extending slightly flared elongated sidewalls 134, 136. The upper edge of each sidewall 134, 136 is rolled over to provide relatively small flange portions 138, 140 adapted to engage and be supported by flange portions 110, 110'. Because sidewalls 134 and 136 are flared outwardly slightly, a slight inward flexing of these sidewalls is required to assemble valance 130 which results in an outwardly directed force operative to retain flange portions 138, 140 of the valance in assembled supporting relationship with flanges 110, 110' of top/shelf 80. It should be noted that valance 130 aids in avoiding glare from light fixture 118. Also, because valance 130 is fabricated from a translucent material, sidewall 134 provides an excellent back lit surface for display of appropriate signage such as a company name and/or logo.

Figure 11:
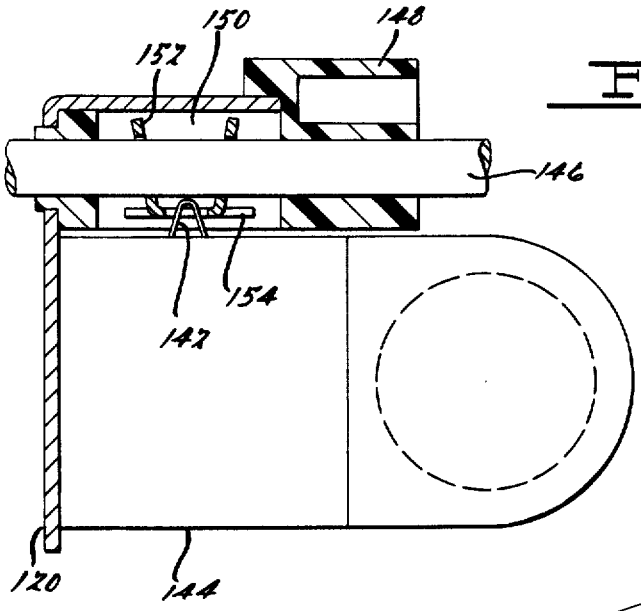
FIG. 11 is a section view of the modified auxiliary lighting unit of FIG. 10, the section being taken along line 11—11 thereof.
Figure 12:
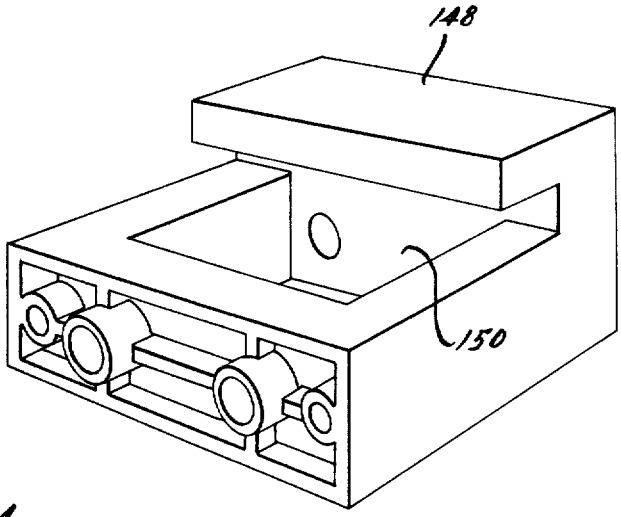
FIG. 12 is a perspective view of the switch block forming a part of the modified lighting assembly of FIG. 10.

While auxiliary lighting unit 118 is provided with a power cord having an on/off switch positioned in line therewith, in some applications it may be desirable to incorporate switch means on the light fixture 118 itself. This may be easily accomplished as shown with reference to FIGS. 10 through 12. In this embodiment, a slide actuated switch 142 is provided on the side of light fixture 144 which operates to energize or de-energize the light fixture. In order to actuate slide switch remotely, an actuator rod 146 is provided slidably supported within housing 148 which in turn is secured to angle bracket 120. Housing 148 defines a cavity 150 surrounding slide switch 142 through which rod 146 extends. An adjustable actuating spring clip 152 is secured to rod 146 within cavity 150 and includes a depending portion 154 surrounding the outwardly protruding portion of slide switch 142. Rod 146 projects outwardly from housing 148 a sufficient distance so as to provide an easily accessible actuating handle portion 156 preferably extending outwardly beyond the front edge of the shelf/top upon which the light fixture is supported. If it is desired to utilize a valance in connection with the switch arrangement, suitable slots may be provided therein through which rod 146 may pass so as to allow easy installation and removal of the valance.

Figure 13:
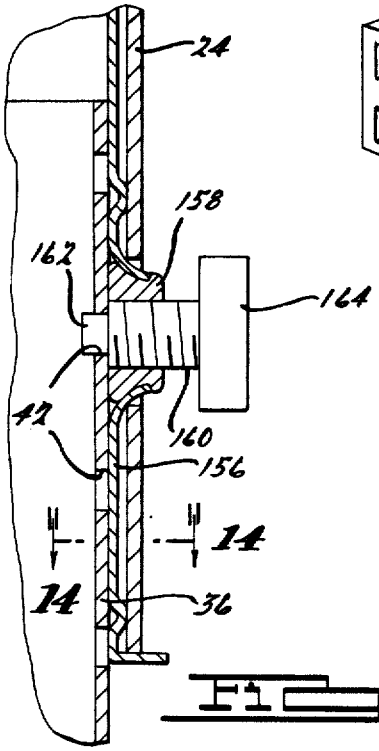
FIG. 13 is a section view of a modified leg construction for use in connection with the work station of FIG. 1, all in accordance with the present invention.
Figure 14:
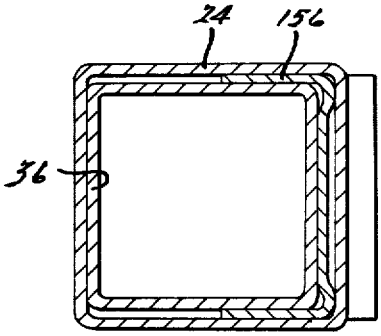
FIG. 14 is a section view of the modified leg construction of FIG. 13, the section being taken along line 14—14 thereof.
Figure 3:
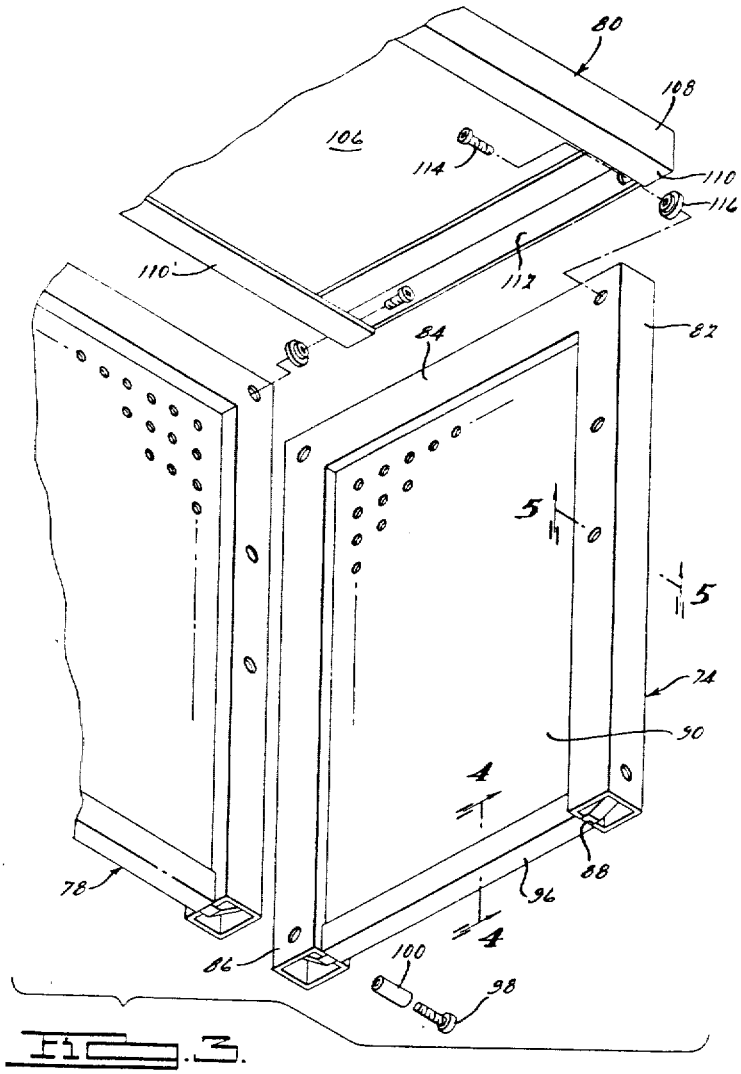

Referring now to FIGS. 13 and 14, a modified leg adjustment arrangement is shown which may be easily incorporated into work station 10. In this embodiment, an L-shaped spacer bracket is provided which has secured thereto a threaded insert 158 which projects outwardly through opening 46 provided in hollow member 24. A threaded member 160 threadedly engages insert 158 and includes an extension 162 which projects through one of the openings 42 provided in extension member 36 so as to lock it in relative position with respect to hollow member 24. Threaded member 160 will preferably have an enlarged diameter knurled portion 164 suitably knurled so as to afford easy and convenient hand operation thereof. This arrangement offers the advantage of requiring only a single threaded insert in order to provide the desirable range of adjustment as opposed to the need to incorporate separate threaded inserts in each of the openings provided on the extension members 36 as well as enabling adjustment of the height of work surface 16 without the need for additional tools.

As may now be appreciated, the present invention provides an exceedingly versatile and durable work station which may be easily and conveniently assembled for use in virtually any desired location.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

I claim:

1. (Amended) A work station comprising:

a work surface;

leg means supporting said work surface;

a privacy panel assembly extending upwardly from and supported on said work surface and extending around a portion of the periphery thereof, said privacy panel assembly including a plurality of panels secured together, each panel including a frame and a sheet member removably fitted within said frame, said frame extending around a peripheral portion of said sheet member, top means supported by said panel assembly and lighting means supported by said top means in overlying relationship to said work surface, said lighting means including mounting means pivotably secured to said lighting means, said mounting means being movable from a first position wherein said mounting means engages said top means to support said lighting means and a second position wherein said lighting means may be removed from said work station.

2. A work station as set forth in claim 1 wherein said frame extends around the periphery of said sheet member and includes a slot for receiving the edges of said sheet member.

3. A work station as set forth in claim 2 wherein said slot is wider than the thickness of said sheet member and further comprising spacer means disposed within said slot between said frame and said sheet member.

4. A work station as set forth in claim 1 wherein said panels are secured together by means of fasteners interconnecting said frames.

5. A work station as set forth in claim 1 further comprising valance means surrounding said light means, said valance means being removably supported from said top means.

6. A work station as set forth in claim 5 wherein said valance means comprises a light diffusing panel having a surface positioned for display of information.

7. A work station as set forth in claim 1 wherein said light means is operative to back light said surface.

8. A work station as set forth in claim 1 wherein said leg means include means for adjusting the height of said work surface.

9. A work station as set forth in claim 8 wherein said adjustment means includes extension members telescopically received within said leg means and locking means to secure said extension members in a desired position with respect to said leg means.

10. A work station comprising:

a first pair of elongated hollow members positioned in substantially parallel spaced relationship by interconnecting members fixedly secured thereto adjacent opposite ends thereof;

a second pair of elongated hollow members positioned in substantially parallel spaced relationship by interconnecting members fixedly secured thereto adjacent opposite ends thereof;

first and second channel members extending between and connected to said first and second pair of leg members to position said first and second pairs of leg members in substantially parellel spaced relationship;

means defining a work surface secured to one end of each of said first and second pairs of leg members;

a privacy assembly secured to and extending upwardly from said work surface, said privacy assembly including first, second, and third panel assemblies, each of said panel assemblies including a panel and hollow slotted frame members extending around the periphery of said panel, edges of said panel being received within said slot, said frame members being fixedly secured together and frame members of adjacent panel assemblies being secured together;

top means secured to an upper end of said privacy assembly and supported thereby, said top means including an upper surface and inwardly extending flange means extending along opposite edges thereof, said flange means being positioned in substantially parallel spaced relationship to said upper surface;

light means including arms pivotably secured thereto, said arms being pivotably movable into a supporting position wherein said flange means cooperates therewith to support said light means; and light diffusing valance means removably supported by said flange means in surrounding relationship to said light means.

11. A work station as set forth in claim 10 further comprising resilient strip means disposed within said slot between said panel and said frame member, said resilient means being operative to inhibit noise generating vibration of said panel within said frame.

12. A work station as set forth in claim 11 wherein said resilient strip means are disposed within said slot in opposite sides of said panel.

13. A work station as set forth in claim 10 wherein said panel is movable within said frame to accommodate expansion and contraction resulting from changing environmental conditions.

14. A work station as set forth in claim 10 further comprising switch means on said light means for selectively energizing said light means and remote actuating means for actuating said switch means.

15. A work station as set forth in claim 14 wherein said remote actuating means comprise a housing associated with said light means, rod means extending outwardly from said housing and slidably movable with respect thereto and spring clip means provided on said rod, said spring clip means being operable to actuate said switch means in response to movement of said rod.

16. (Added) A work station comprising:

a work surface;

leg means supporting said work surface;

a privacy assembly secured to and extending upwardly from said work surface, said privacy assembly including first, second, and third panel assemblies, each of said panel assemblies including a panel and hollow slotted frame members extending around the periphery of said panel, edges of said panel being received within said slot, said frame members being fixedly secured together and frame members of adjacent panel assemblies being secured together;

top means secured to an upper end of said privacy assembly and supported thereby, said top means including an upper surface and inwardly extending flange means extending along opposite edges thereof, said flange means being positioned in substantially parallel spaced relationship to said upper surface;

light means supported by said flange means; and light diffusing valance means removably supported by said flange means in surrounding relationship to said light means, said valance means including a generally vertically extending outwardly facing surface for display of information, said light means being operative to backlight said surface.

* * * * *

UNITED STATES PATENT AND TRADEMARK OFFICE

CERTIFICATE OF CORRECTION

PATENT NO. : 4,905,609

DATED : Mar. 6, 1990

INVENTOR(S) : Gordon Haskins

It is certified that error appears in the above-identified patent and that said Letters Patent is hereby corrected as shown below:

In the Drawings, third sheet which is 2 of 6 should be deleted, and sheet 3 of 6 should be added as shown on the attached sheet.

Signed and Sealed this

Twenty-fifth Day of February, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,905,609

DATED : March 6, 1990

INVENTOR(S) : Gordon Haskins

It is certified that error appears in the above-identified patent and that said Letters Patent is hereby corrected as shown below:

Column 6, line 19, Claim 1, delete "(Amended)".

Column 7, line 12, Claim 10, "parellel" should be --parallel--.

Column 8, line 19, Claim 16, delete "(Added)".

Signed and Sealed this

Thirteenth Day of October, 1992

*Attest:*

*Attesting Officer*

DOUGLAS B. COMER

*Acting Commissioner of Patents and Trademarks*